US010978841B2

(12) United States Patent
Liao

(10) Patent No.: US 10,978,841 B2
(45) Date of Patent: Apr. 13, 2021

(54) CONNECTOR CONVERTER

(71) Applicant: GUANGDONG GOPOD GROUP HOLDING CO., LTD., Shenzhen (CN)

(72) Inventor: Zhuowen Liao, Shenzhen (CN)

(73) Assignee: GUANGDONG GOPOD GROUP HOLDING CO., LTD., Shenzhen (CN)

( * ) Notice: Subject to any disclaimer, the term of this patent is extended or adjusted under 35 U.S.C. 154(b) by 0 days.

(21) Appl. No.: 16/626,878

(22) PCT Filed: Oct. 11, 2017

(86) PCT No.: PCT/CN2017/105692
§ 371 (c)(1),
(2) Date: Dec. 26, 2019

(87) PCT Pub. No.: WO2019/071467
PCT Pub. Date: Apr. 18, 2019

(65) Prior Publication Data
US 2020/0235538 A1 Jul. 23, 2020

(51) Int. Cl.
*H01R 27/02* (2006.01)
*H01R 31/06* (2006.01)
(Continued)

(52) U.S. Cl.
CPC ..... *H01R 31/065* (2013.01); *H01R 13/502* (2013.01); *H01R 13/60* (2013.01);
(Continued)

(58) Field of Classification Search
CPC ..... H01R 31/065; H01R 24/64; H01R 31/06; H01R 2107/00; H01R 24/60; H01R 27/02;
(Continued)

(56) References Cited

U.S. PATENT DOCUMENTS 7,563,136 B1 * 7/2009 Wu ..... H01R 13/65912 439/607.35
7,621,758 B2 * 11/2009 Tsao ..... H01R 24/50 439/79
(Continued)

FOREIGN PATENT DOCUMENTS

CN 103618160 A 3/2014
CN 204835144 U 12/2015
(Continued)

OTHER PUBLICATIONS

International Search Report and Written Opinion, for Application No. PCT/CN2017/105692, dated Jan. 23, 2018.

*Primary Examiner* — Truc T Nguyen
(74) *Attorney, Agent, or Firm* — Dorsey & Whitney LLP

(57) ABSTRACT

Provided is a connector converter, comprising a shell a digital signal board, a power source board and a connecting wire, wherein the digital signal board and the power source board are respectively integrated with a digital circuit and a power source circuit, the digital signal board and the power source board are both provided in the shell and electrically connected to each other, an inner end of the connecting wire is electrically connected to the digital signal board, an outer end of the connecting wire extends out of the shell and is provided with an input interface, the digital signal board is provided with a plurality of output interfaces, and the shell is provided with an outer pocket. The digital signal board and the power source board are respectively integrated with the digital circuit and the power source circuit.

15 Claims, 6 Drawing Sheets

(51) Int. Cl.
*H01R 13/502* (2006.01)
*H01R 13/60* (2006.01)
*H01R 13/66* (2006.01)
*H01R 13/72* (2006.01)

(52) U.S. Cl.
CPC ..... *H01R 13/6658* (2013.01); *H01R 13/72* (2013.01); *H01R 27/02* (2013.01)

(58) Field of Classification Search
CPC ..... H01R 13/58; H01R 13/6205; H01R 13/6658; H01R 13/6675; H01R 13/6691; H01R 13/70; H01R 13/7175; H01R 25/006; H01R 31/02; H01R 12/53; H01R 12/58; H01R 12/714; H01R 12/721; H01R 12/73; H01R 13/426; H01R 13/436; H01R 13/502; H01R 13/514; H01R 13/516; H01R 13/5804; H01R 13/60; H01R 13/627; H01R 13/629; H01R 13/62933; H01R 13/635; H01R 13/6392; H01R 13/6395; H01R 13/6595; H01R 13/66; H01R 13/665; H01R 13/6666; H01R 13/6683; H01R 13/7031; H01R 13/7032; H01R 13/713; H01R 13/7177; H01R 13/72; H01R 13/74; H01R 2103/00; H01R 2105/00; H01R 2201/04; H01R 2201/12; H01R 2201/20; H01R 2201/26; H01R 24/00; H01R 24/50; H01R 24/542; H01R 24/66; H01R 24/68; H01R 24/76; H01R 27/00; H01R 29/00; H01R 33/94; H01R 35/02; H01R 43/205; H01R 43/24; H01R 43/26; H01R 4/2416; H01R 9/16
See application file for complete search history.

(56) References Cited

U.S. PATENT DOCUMENTS

| | | | | |
|---|---|---|---|---|
| 8,043,122 | B1 | 10/2011 | Cho et al. | |
| 2009/0129002 | A1* | 5/2009 | Wu | G06F 1/185 361/679.4 |
| 2012/0094508 | A1* | 4/2012 | Tao | H01R 31/005 439/76.1 |
| 2013/0040470 | A1* | 2/2013 | Gao | H01R 13/658 439/39 |
| 2014/0078387 | A1* | 3/2014 | Tao | H04N 5/2252 348/374 |
| 2018/0165053 | A1* | 6/2018 | Kuo | G06F 1/16 |
| 2019/0204882 | A1* | 7/2019 | Tseng | G06F 1/1632 |
| 2019/0341714 | A1* | 11/2019 | Du | H01R 13/42 |
| 2019/0341793 | A1* | 11/2019 | Chien | F21V 33/004 |

FOREIGN PATENT DOCUMENTS

| | | | |
|---|---|---|---|
| CN | 106253012 | A | 12/2016 |
| WO | 2011031114 | A2 | 3/2011 |

* cited by examiner

CONNECTOR CONVERTER

RELATED APPLICATIONS

This application is a 371 National Stage application claiming priority to International Application No. PCT/CN2017/105692, filed Oct. 11, 2017. The aforementioned application is incorporated herein by reference, in its entirety, for any purposes.

TECHNICAL FIELD

The present invention belongs to the technical field of converters, and particularly relates to a connector converter.

BACKGROUND OF THE INVENTION

A connector converter is a device that can convert connectors to each other for the purpose of signal conversion or charging interface conversion. An existing connector converter generally comprises a shell, a printed circuit board provided in the shell, an adapter socket mounted on the printed circuit board, and a wire welded to the printed circuit board and used for receiving electrical signals or other signals. However, the existing connector converter has the problem of signal interference during operation, thus affecting the use effect of the connector converter.

Technical Problem

An object of the present invention is to provide a connector converter to solve the technical problem of signal interference of the connector converter during use in the prior art.

SUMMARY OF THE INVENTION

Solution to the Problem

Technical Solution

In order to solve the above-mentioned technical problem, a technical solution used by the embodiment of the present invention is to provide a connector converter comprising a shell, a digital signal board, a power source board and a connecting wire, wherein the digital signal board is integrated with a digital circuit, the power source board is integrated with a power source circuit, the digital signal board and the power source board are both provided in the shell and electrically connected to each other, an inner end of the connecting wire is electrically connected to the digital signal board, an outer end of the connecting wire extends out to the shell and is provided with an input interface, the digital signal board is provided with a plurality of output interfaces, and the shell is provided with an outer pocket positioned corresponding to the output interface such that the output interface is exposed.

Preferably, the digital signal board and the power source board are provided side by side.

Preferably, the digital signal board and the power source board are provided at a distance from each other.

Preferably, the output interfaces are positioned between the digital signal board and the power source board to space apart the digital signal board and the power source board.

Preferably, the digital signal board is electrically connected to the power source board via at least one pin header set.

Preferably, each of the pin header set comprises a plurality of connecting pin headers which are provided side by side, and each of the connecting pin header is vertically welded between the digital signal board and the power source board.

Preferably, an inner end of the connecting wire is provided with a metal plate, the metal plate being embedded in the digital signal board and electrically connected to the digital signal board via a connecting terminal.

Preferably, a connecting position between the connecting terminal and the metal plate is provided with a UV adhesive fixedly sealing on the digital signal board.

Preferably, the metal plate comprises a middle plate part, a first lateral plate part and a second lateral plate part, the middle plate part being fixedly connected to the inner end of the connecting wire, the first lateral plate part and the second lateral plate part being respectively connected to two ends of the same side of the middle plate part, and the first lateral plate part and the second lateral plate part being both electrically connected to the digital signal board via the connecting terminal; and a bottom end of the first lateral plate part being provided with a first embedding part, a bottom end of the second lateral plate part being provided with a second embedding part, the digital signal board being provided with a first embedding groove and a second embedding groove at a position close to an end thereof, the first embedding part and the second embedding part being respectively embedded in the first embedding groove and the second embedding groove such that the metal plate is fixedly connected to the digital signal board.

Preferably, the digital signal board is provided with a mounting notch positioned below the position between the first lateral plate part and the second lateral plate part, and the middle plate part is clamped in the mounting notch.

Preferably, the inner end of the connecting wire is fixedly connected to the middle plate part via a wire clamping ring.

Preferably, the output interfaces are any combination of a USB interface, an HDMI interface, a DVI interface, an RJ45 interface and a Lightning interface.

Preferably, the input interface is a Type-C interface or a Micro USB interface.

Preferably, the digital signal board and/or the power source board is provided with a plurality of electronic devices.

Preferably, the shell comprises an outer frame and two plugs, the outer frame being provided with a mounting cavity and the mounting cavity penetrating through two ends in a length direction of the outer frame, the two plugs being plugged at two ends of the mounting cavity, and the outer pockets being formed in the outer frame and/or the plug.

Preferably, the shell further comprises a plastic member, the plastic member being fixed in the mounting cavity, the plastic member being provided with an inner pocket positioned corresponding to the outer pocket formed in the outer frame, and the end of the output interface corresponding to the inner pocket being fixed to the inner pocket.

Preferably, the outer frame is an aluminum alloy frame with an oxide layer formed on the surface.

BENEFICIAL EFFECTS OF THE INVENTION

Beneficial Effects

Compared with the prior art, the beneficial effects of a connector converter provided in various embodiments of the present invention lie in that according to the connector converter of the present invention, conversion between connectors can be achieved by connecting an input interface provided at an outer end of a connecting wire with an interface needing signal conversion or an interface of a charging power source, and then plugging a data cable connected to an electronic product in an outer pocket exposed outside an exposed shell; the connector converter of the present invention is provided with a digital signal board and a power source board, and the digital signal board and the power source board are respectively integrated with a digital circuit and a power source circuit, so that signal interference between the digital circuit and power source circuit can be effectively avoided during operation of the connector converter, thereby ensuring a better using effect of the connector converter, as well as facilitating better heat dissipation of the connector converter.

BRIEF DESCRIPTION OF THE DRAWINGS

In order to more clearly explain the technical solutions in the embodiments of the present invention, the accompanying drawings to be used in the description of the embodiments or the prior art will be briefly introduced below. Obviously, the accompanying drawings described below are merely some embodiments of the present invention, and a person of ordinary skill in the art would have obtained other drawings according to these drawings without involving any inventive effort.

Figure 1:
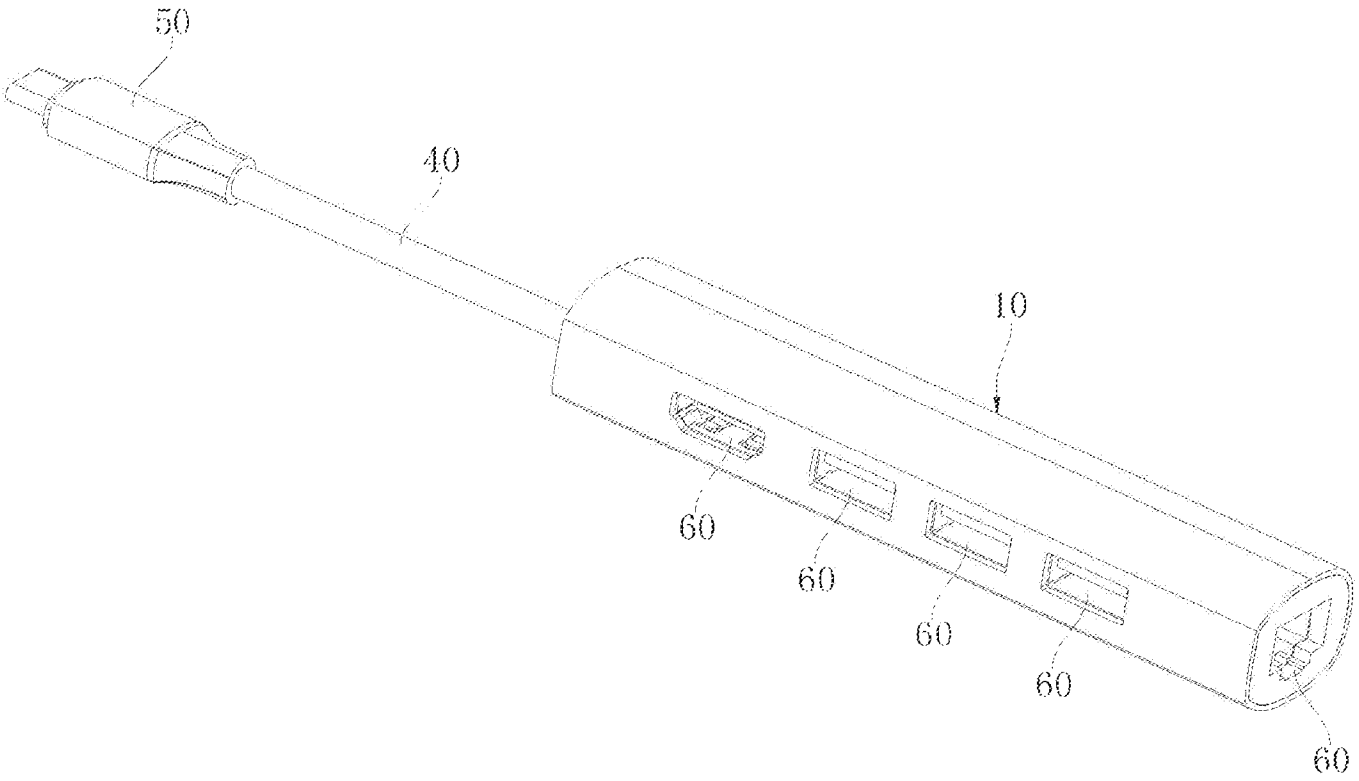
FIG. 1 is a schematic structural diagram of a connector converter provided in an embodiment of the present invention.

Reference signs in the drawings are as follows:

| | | |
|---|---|---|
| 10. Shell | 11. Outer frame | 12. Plug |
| 13. Plastic member | 20. Digital signal board | 21. First embedding groove |
| 22. Second embedding groove | 23. Mounting notch | 30. Power source board |
| 40. Connecting wire | 50. Input interface | 60. Output interface |
| 70. Pin header set | 71. Connecting pin header | 80. Wire clamping ring |
| 90. Metal plate | 91. First lateral plate part | 92. Second lateral plate part |
| 93. Middle plate part | 94. First embedding part | 95. Second embedding part |
| 100. Connecting terminal | 110. UV adhesive | 111. Outer pocket |
| 120. Electronic device | 131. Inner pocket. | |

DETAILED DESCRIPTION OF EMBODIMENTS

The embodiments of the present invention are described below in detail, examples of which are shown in the accompanying drawings, wherein, throughout, the same or similar reference numerals represent the same or similar elements or elements having the same or similar functions. The embodiments described below with reference to FIGS. 1-7 are exemplary and are intended to be illustrative of the present invention, and will not be interpreted as limiting the present invention.

In the description of the present invention, it should be understood that the orientation or positional relationships indicated by the terms "length", "width", "upper", "lower", "front"; "rear", "left", "right", "vertical", "horizontal", "top", "bottom", "inner", "outer" etc. are based on the orientation or positional relationship shown in the accompanying drawings and are only for facilitating the description of the present invention and simplifying the description, rather than indicating or implying that the device or element referred to must have a particular orientation or be constructed and operated in a particular orientation, and therefore will not be interpreted as limiting the present invention.

In addition, the terms "first" and "second" are for descriptive purposes only and should not be construed as indicating or implying relative importance or implicitly indicating the number of technical features indicated. Thus, the features defined with "first" and "second" can explicitly or implicitly include one or more of the features. In the description of the present invention, the word "multiple" means two or more, unless otherwise explicitly and specifically defined.

In the present invention, unless otherwise explicitly specified and defined, terms "mounting", "connecting", "connection", "fix" and the like should be understood in a broad sense, for example, they can be a fixed connection, a detachable connection, or being integrated; can be a mechanical connection or an electrical connection; can be a direct connection or an indirect connection through a medium; and can be communication between interiors of two elements or interactive relationship of two elements. For those of ordinary skill in the art, the specific meaning of the terms mentioned above in the present invention should be construed according to specific circumstances.

As shown in FIGS. 1-7, a connector converter is provided in an embodiment of the present invention, the connector converter comprises a shell 10, a digital signal board 20, a power source board 30 and a connecting wire 40, wherein the digital signal board 20 is integrated with a digital circuit, the power source board 30 is integrated with a power source circuit, the digital signal board 20 and the power source board 30 are both provided in and electrically connected to the shell 10, an inner end of the connecting wire 40 is electrically connected to the digital signal board 20, an outer end of the connecting wire 40 extends out of the shell 10 and is provided with an input interface 50, the digital signal board 20 is provided with a plurality of output interfaces 60, and the shell 10 is provided with an outer pocket 111 positioned corresponding to the output interface 60 such that the output interface 60 is exposed. As shown in combination with FIGS. 2-4, specifically, according to the connector converter in the embodiment of the present invention, conversion between connectors can be achieved by connecting an input interface 50 provided at an outer end of a connecting wire 40 with an interface needing signal conversion or an interface of a charging power source, and then plugging a data cable connected to an electronic product in an outer pocket 111 exposed outside an exposed shell 10; the connector converter in the embodiment of the present invention is provided with the digital signal board 20 and the power source board 30, and the digital signal board 20 and the power source board 30 are respectively integrated with the digital circuit and the power source circuit, so that signal interference between the digital circuit and power source circuit can be effectively avoided during operation of the connector converter, thereby ensuring a better using effect of the connector converter, as well as facilitating better heat dissipation of the connector converter.

Figure 3:
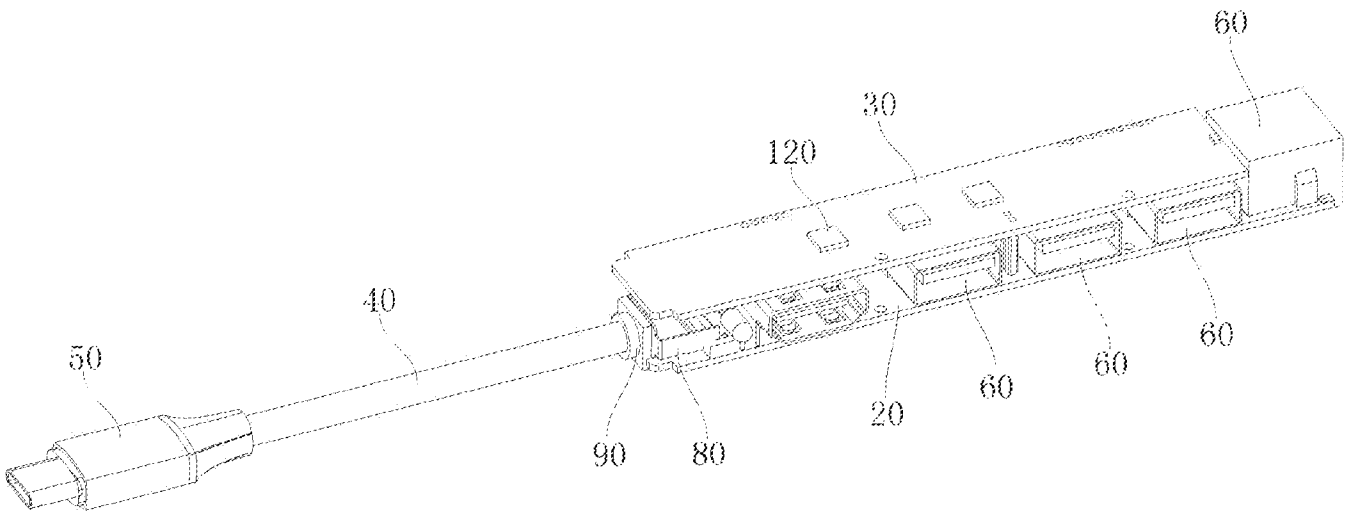
FIG. 3 is a first schematic structural diagram of the connector converter with a shell being hidden provided in the embodiment of the present invention.
Figure 4:
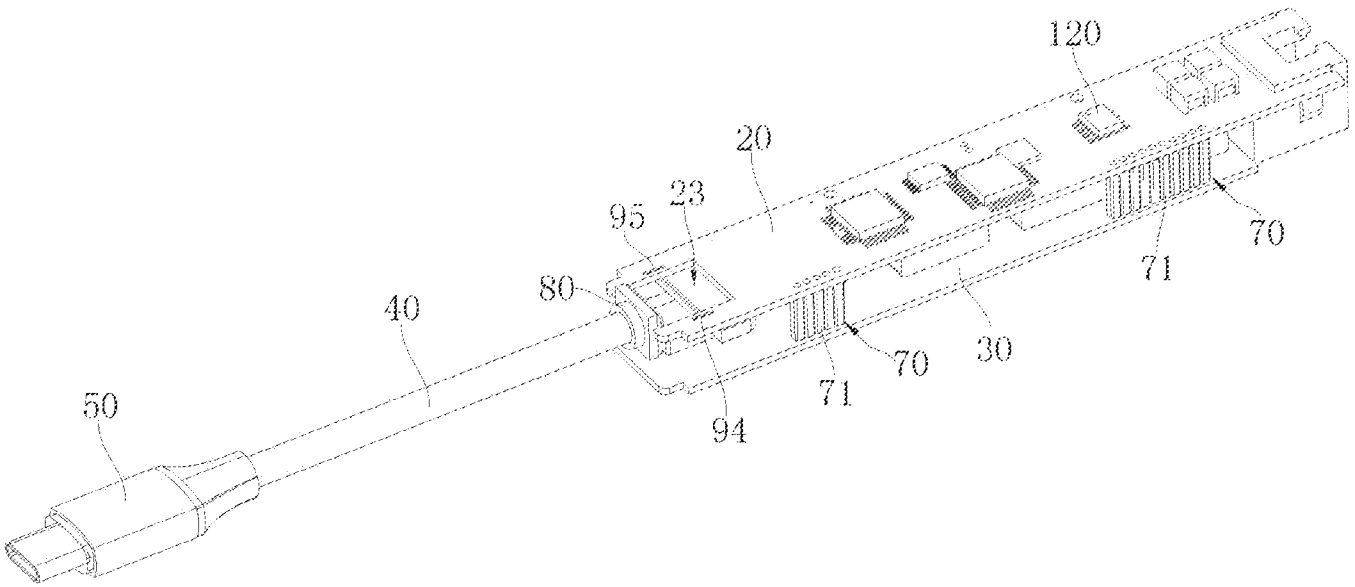
FIG. 4 is a second schematic structural diagram of the connector converter with the shell being hidden provided in the embodiment of the present invention.

In the present embodiment, as shown in FIGS. 3 and 4, the digital signal board 20 and the power source board 30 are provided side by side. Specifically, the digital signal board 20 and the power source board 30 are provided side by side, and therefore when the digital signal board 20 and the power source board 30 are mounted, the best position can be conveniently placed in space to save on the space occupied by the digital signal board 20 and the power source board 30.

Preferably, as shown in FIGS. 3 and 4, the digital signal board 20 and the power source board 30 are provided side by side in a vertical direction in height, and therefore the space occupied by the whole connector converter in a length direction in a limited space is decreased, further the volume of the whole connector converter can be decreased, and the connector converter is conveniently designed in a miniaturization manner.

In the present embodiment, as shown in FIGS. 3 and 4, the digital signal board 20 and the power source board 30 are provided at a distance from each other. Specifically, the digital signal board 20 and the power source board 30 are provided at an interval, such that a gap is formed between the digital signal board 20 and the power source board 30, in this way, heat generated by the digital signal board 20 and the power source board 30 can dissipate in the gap, thus effectively ensuring dissipation of the heat generated by the digital signal board 20 and the power source board 30, and thereby avoiding influence on operation or a shortened service life due to accelerated aging of various components caused by excessive heat of the interior of the connector converter.

In the present embodiment, as shown in FIGS. 3 and 4, the output interfaces 60 are positioned between the digital signal board 20 and the power source board 30 to space apart the digital signal board 20 and the power source board 30. Specifically, the output interfaces 60 space apart the digital signal board 20 and the power source board 30, such that the gap between the digital signal board 20 and the power source board 30 is maximized in the limited space in the shell 10, and therefore the heat generated by the digital signal board 20 and the power source board 30 during working can dissipate most efficiently, and further the impact on the connector converter by the high temperature is avoided, and working stability and reliability of the connector converter are ensured.

Figure 2:
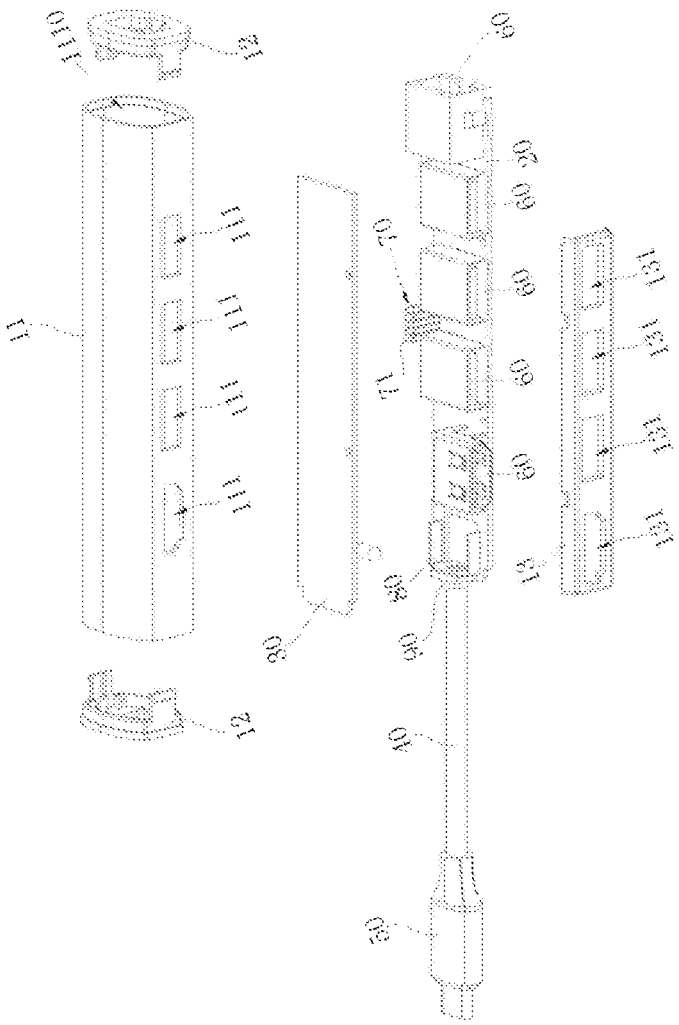
FIG. 2 is a schematic exploded structural diagram of the connector converter provided in the embodiment of the present invention.

In the present embodiment, as shown in FIGS. 2 and 4, the digital signal board 20 is electrically connected to the power source board 30 via at least one pin header set 70. Specifically, the pin header set 70 can, on the one hand, electrically connect the digital signal board 20 and the power source board 30 and ensure that the digital signal board 20 and the power source board 30 can work normally, and on the other hand, support the digital signal board 20 and the power source board 30, that is, enhancing the stability of arrangement of the digital signal board 20 and the power source board 30 in the shell 10 and avoiding detachment of the digital signal board 20 and the power source board 30 caused by action of external forces.

Further, one pin header set 70, two pin header sets 70 or three pin header sets 70 can be provided according to actual needs.

More specifically, as shown in FIGS. 3 and 4, the arrangement position of each pin header set 70 can be the position on the other side corresponding to the output interface 60, in this way, interference between the pin head set 70 and the output interface 60 is avoided, it is ensured that the components are mounted in coordination with one another, do not affect operation of one another, and can achieve the normal function thereof respectively.

In the present embodiment, as shown in FIGS. 2 and 4, each pin header set 70 comprises a plurality of connecting pin headers 71 which are provided side by side, and each connecting pin header 71 is vertically welded between the digital signal board 20 and the power source board 30. Specifically, preferably, each pin header set 70 is composed of a plurality of connecting pin headers 71, for example, the number of the connecting pin headers 71 in each pin header set 70 can be five. Two ends of each connecting pin header 71 can be respectively inserted on the digital signal board 20 and the power source board 30, and the inserting positions between the connecting pin header 71 and the digital signal board 20 and between the connecting pin header 71 and the power source board 30 are reinforced by soldering tin, in this way, the mechanical connection between the connecting pin header 71 and the digital signal board 20 and the power source board 30 is ensured to be achieved, and the electric connection between the connecting pin header 71 and the digital signal board 20 and the power source board 30 is ensured to be achieved, and practicability of the physical design is high.

In the present embodiment, as shown in FIGS. 2 and 3 and 5 and 6, an inner end of the connecting wire 40 is provided with a metal plate 90, the metal plate 90 being embedded in the digital signal board 20 and electrically connected to the digital signal board 20 via a connecting terminal 100. Specifically, the arrangement of the metal plate 90 can reinforce stability of connection between the connecting wire 40 and the digital signal board 20, the metal plate 90 is connected to the digital signal board 20 in an embedded manner, and therefore the problem of detachment of the connecting wire 40 and the digital signal board 20 can be effectively avoided. Similarly, the metal plate 90 is embedded in a digital signal board 20 of a circuit board assembly, then the metal plate 90 is electrically connected to the digital signal board 20 via a connecting terminal 100, such that the connecting wire 40 can be electrically connected and mechanically connected to the digital signal board 20, and the mechanical connection is achieved by an embedding manner instead of welding, thus greatly improving stability of the mechanical connection between the connecting wire 40 and the digital signal board 20, avoiding detachment of the connecting wire 40 during use of the connector converter, and ensuring a better using effect of the connector converter.

Figure 5:
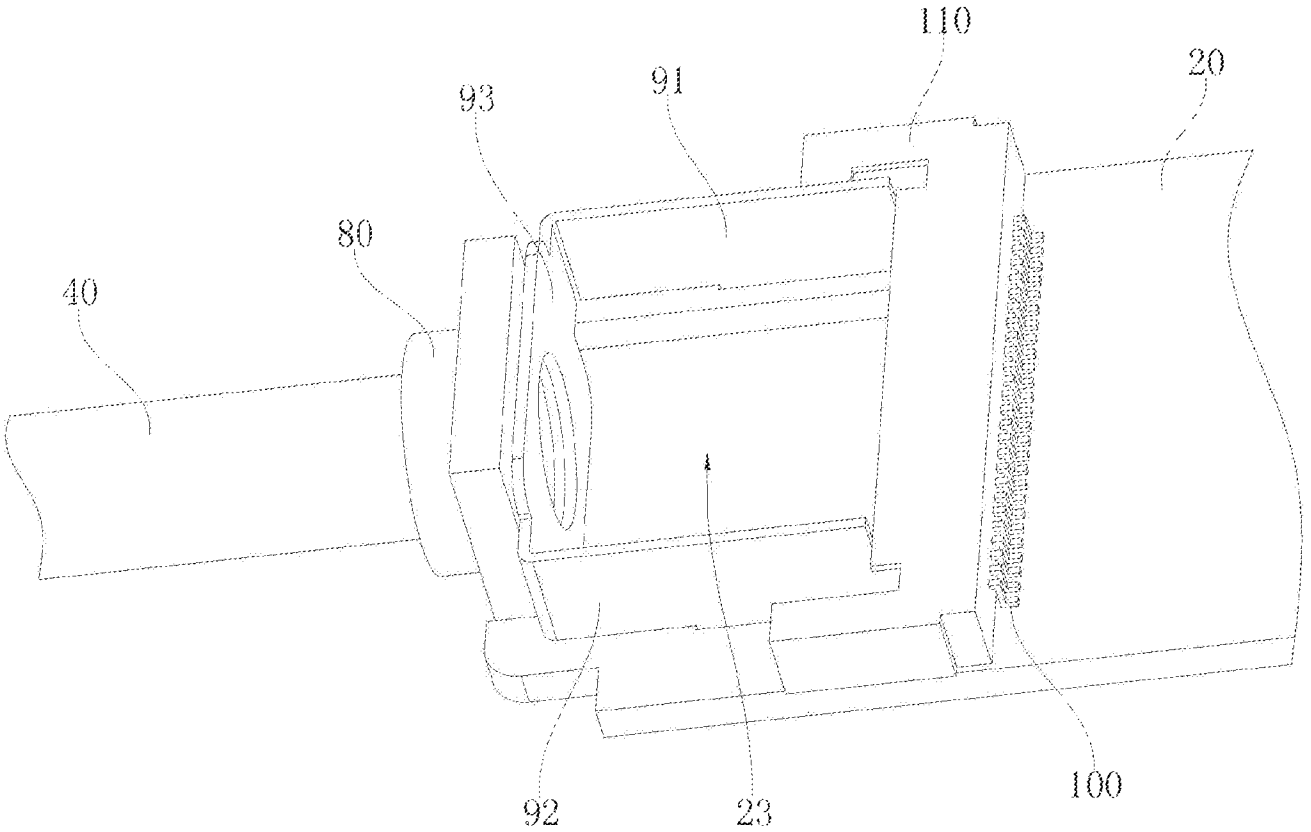
FIG. 5 is a schematic structural diagram of a connecting wire being connected to the digital signal board via the metal plate of the connector converter provided in the embodiment of the present invention.

In the present embodiment, as shown in FIG. 5, a connecting position between the connecting terminal 100 and the metal plate 90 is provided with a UV adhesive 110 fixedly sealing on the digital signal board 20. Specifically, the function of the UV adhesive 110 is to reinforce connection between the connecting terminal 100 and the metal plate 90, and further, to fix the connecting terminal 100 and the metal plate 90 to the digital signal board 20. The three, i.e. the metal plate 90, the connecting terminal 100 and the digital signal board 20 can be contained via the UV adhesive 110, thus greatly improving stability of the connection of the metal plate 90, the connecting terminal 100 and the digital signal board 20. In addition, the UV adhesive 110 is of an insulation material and can effectively prevent interference with operation of other components on the digital signal board 20, that is, the UV adhesive 110 will not cause other adverse problems except for reinforcing the stability of the connection of the metal plate 90, the connecting terminal 100 and the digital signal plate 20.

Figure 6:
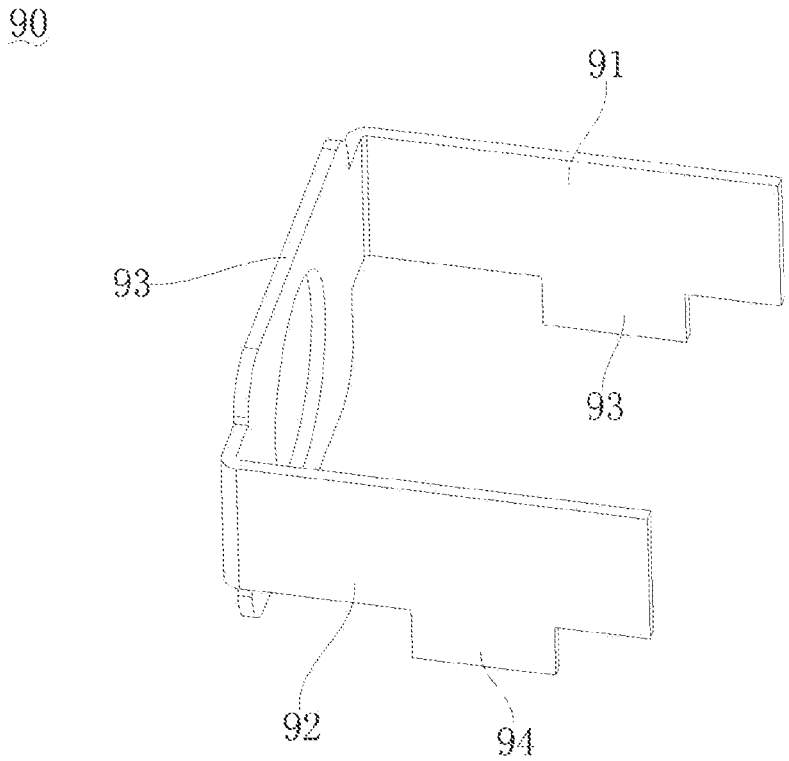
FIG. 6 is a schematic structural diagram of the metal plate of the connector converter provided in the embodiment of the present invention.
Figure 7:
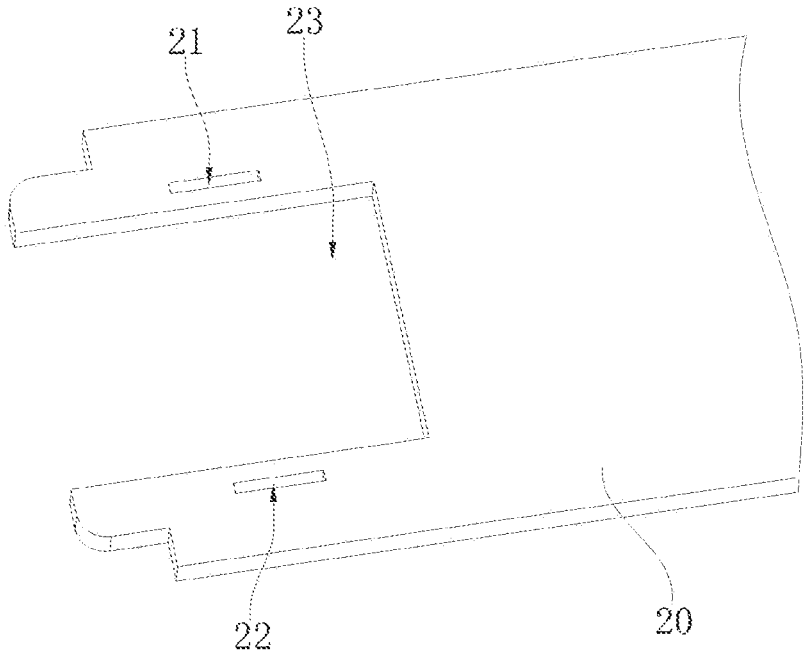
FIG. 7 is a schematic structural diagram of the digital signal board of the connector converter provided in the embodiment of the present invention.

In the present embodiment, as shown in FIGS. 5-7, the metal plate 90 comprises a middle plate part 93, a first lateral plate part 91 and a second lateral plate part 92, the middle plate part 93 being fixedly connected to the inner end of the connecting wire 40, the first lateral plate part 91 and the second lateral plate part 92 being respectively connected to two ends of the same side of the middle plate part 93, and the first lateral plate part 91 and the second lateral plate part 92 being both electrically connected to the digital signal board 20 via the connecting terminal 100; and a bottom end of the first lateral plate part 91 being provided with a first embedding part 94, a bottom end of the second lateral plate part 92 being provided with a second embedding part 95, the position of the digital signal board 20 that is close to the end of the digital signal board being provided with a first embedding groove 21 and a second embedding groove 22, the first embedding part 94 and the second embedding part 95 being respectively embedded in the first embedding groove 21 and the second embedding groove 22 such that the metal plate 90 is fixedly connected to the digital signal board 20. Specifically, the middle plate part 93 is connected between the first lateral plate part 91 and the second lateral plate part 92, the middle plate part 93 is fixedly connected to the connecting wire 40, the first embedding part 94 provided on the first lateral plate part 91 and the second embedding part 95 provided on the second lateral plate part 92 are respectively embedded in the first embedding groove 21 and the second embedding groove 22 on the digital signal board 20, in this way, the connecting wire 40 is mechanically connected to the digital signal board 20 at positions of two points via the first embedding part 94 and the second embedding part 95, thus greatly improving stability of connection between the connecting wire 40 and the digital signal board 20, and the connecting wire 40 is not prone to separating from the connection to the digital signal board 20 even if a certain extra force is applied to pull the connecting wire 40.

When the first embedding part 94 and the second embedding part 95 are respectively embedded in the first embedding groove 21 and the second embedding groove 22, the bottom end of the first lateral plate part 91 and the bottom end of the second lateral plate part 92 abut against the surface of the digital signal board 20, in this way, on the one hand, the condition that waggling and the like that may occur and cause connection loosening due to gaps existing between the first lateral plate part 91 and the second lateral plate part 92 and the digital signal board 20 can be avoided, on the other hand, during assembly, whether the first lateral plate part 91 and the second lateral plate part 92 are mounted in place can be quickly known by observing, thus decreasing various problems in subsequent use caused by poor installation.

In the embodiment, the width of the middle plate part 93 is greater than that of the first lateral plate part 91 and the second lateral plate part 92, and the width of the first lateral plate part 91 is equal to that of the second lateral plate part 92.

Preferably, the metal plate 90 is fabricated by integrally forming the middle plate part 93, the first lateral plate part 91, the second lateral plate part 92, the first embedding part 94 and the second embedding part 95, the metal plate 90 fabricated by integral forming is high in structural strength and is suitable for mass production, the production cost is low, and meanwhile, the fabricated metal plate 90 has good product consistency.

More specifically, as shown in FIG. 6, the configuration structure of the metal plate 90 is generally in a U shape, and the metal plate 90 of such a structure is good in stability and more reliable in use.

In the present embodiment, as shown in FIGS. 4 and 5 and 7, the digital signal board 20 is provided with a mounting notch 23 positioned below the position between the first lateral plate part 91 and the second lateral plate, and the middle plate part 93 is clamped in the mounting notch 23. Specifically, the first embedding groove 21 and the second embedding groove 22 are respectively positioned at opposite edges close to the mounting notch 23, in this way, after the metal plate 90 is connected to the digital signal board 20, the first lateral plate part 91 and the second lateral plate part 92 are respectively positioned at the opposite edges close to the mounting notch 23 and the middle plate part 93 right faces the mounting notch 23, the connecting wire 40 connected to the middle plate part 93 is centralized, the connecting wire 40 is indirectly contained via the first lateral plate part 91 and the second lateral plate part 92 at two points in a width direction of the digital signal board 20, such that connection between the connecting wire 40 and the digital signal board 20 is stable and reliable.

In the present embodiment, as shown in FIGS. 2-4, the inner end of the connecting wire 40 is fixedly connected to the middle plate part 93 via a wire clamping ring 80. Specifically, a plastic material can be used for supporting the wire clamping ring 80; and by means of the wire clamping ring, the middle plate part 93 of the metal plate 90 and the connecting wire 40 can be firmly connected, the end of the connecting wire 40 can be protected, the connecting wire 40 can be prevented from end breaking during long-time use, and the service life of the connector converter is prolonged.

In the present embodiment, the output interfaces 60 are any combination of a USB interface, an HDMI interface, a DVI interface, an RJ45 interface and a Lightning interface. Specifically, the USB interface, the HDMI interface, the DVI interface, the RJ45 interface, and the Lightning interface can be selected as needs actually to be mounted on the digital signal board 20, wherein, the number of each kind of interfaces can be selected as more than one, for example, three USB interfaces are selected. Certainly, the USB interface, the HDMI interface and the RJ45 interface can also be selected to form an interface group to be mounted on the digital signal board 20.

In the present embodiment, the input interface 50 is a Type-C interface or a Micro USB interface. Specifically, the input interface 50 can be provided as a Type-C interface or a Micro USB interface as needed.

In this way, the output interface 60 and the input interface 50 listed above are used, such that types of connector converter products diversify, and therefore the needs of different groups of people are met, and the market adaptability is higher.

In the present embodiment, as shown in FIGS. 3 and 4, the digital signal board 20 and/or the power source board 30 is provided with a plurality of electron devices 120. Specifically, arrangement of the electron device 120 is used for assisting working of the digital signal board 20 and the power source board 30, ensuring that the function attached to the connector converter can be achieved.

In the present embodiment, as shown in FIG. 2, the shell 10 comprises an outer frame 11 and two plugs 12, the outer frame 11 being provided with a mounting cavity 1110 and the mounting cavity penetrating through two ends in a length direction of the outer frame, the two plugs 12 being plugged at two ends of the mounting cavity, and the outer pockets 111 being formed in the outer frame 11 and/or the plug 12. Specifically, the outer frame 11 is a main body of the whole connector converter, playing a role of mounting and fixing each component, and providing the mounting cavity 1110 in the outer frame 11 is for mounting and fixing of the digital signal board 20, the power source board 30 and each output interface 60. The structure is two ends of the mounting cavity being penetrated through, in this way, when the digital signal board 20 and the power source board 30 are mounted, same can be plugged in at two end openings of the mounting cavity, and the two plugs 12 are plugged into the two end openings of the mounting cavity 1110 to prevent the digital signal board 20 and the power source board 30 from falling out of the outer frame 11. The well mounted output interface 60 right corresponds to the outer pocket 111, thus allowing each output interface 60 to be exposed for convenient use.

In the present embodiment, as shown in FIG. 2, the shell 10 further comprises a plastic member 13, the plastic member 13 being fixed in the mounting cavity 1110, the plastic member 13 being provided with an inner pocket 131 positioned corresponding to the outer pocket 111 in the outer frame 11, and the end of the output interface 60 corresponding to the inner pocket 131 being fixed to the inner pocket 131. Specifically, the function of the plastic member 13 is to reinforce the output interfaces 60, the inner pocket 131 provided thereon can ensure cooperation with the outer pocket 111, such that the output interfaces 60 are exposed. When each output interface 60 is in use, the end thereof bears larger force, and therefore when each output interface 60 is fixed to the inner pocket 131, strength of each output interface 60 can be improved via the plastic member 13, the output interface is prevented from detachment and occurrence of other problems after bearing a force, and the practicability of physical design is high.

In the present embodiment, the outer frame 11 is an aluminum alloy frame with an oxide layer formed on the surface. Specifically, being an aluminium alloy frame, the outer frame 11 has higher structural strength, and is not prone to deformation even if it falls from a height or bears a large external force, thereby effectively protecting components provided in the outer frame 11. In addition, due to the oxide layer formed on the surface of the aluminum alloy frame, the aluminum alloy frame is further prevented from interfering with the operation of the digital signal board 20 and the power source board 30.

The above description is only preferred embodiments of the invention, not intended to limit the present invention. Any modifications, equivalent replacements, or improvements made within the spirit and principles of the present invention should be included within the scope of protection of the present invention.

The invention claimed is:

1. A connector converter comprising:

a shell, a digital signal board, wherein the digital signal board is integrated with a digital circuit, wherein the digital signal board is provided in the shell and provided with a plurality of output interfaces, and wherein the shell is provided with one or more outer pockets positioned corresponding to a respective output interface of the plurality of output interfaces such that the respective output interface is exposed;

a power source board provided in the shell, wherein the power source board is integrated with a power source circuit, and wherein the digital signal board and the power source board are electrically connected to each other; and a connecting wire, wherein an inner end of the connecting wire is electrically connected to the digital signal board, an outer end of the connecting wire extends out to the shell and is provided with an input interface, wherein an inner end of the connecting wire is provided with a metal plate, the metal plate being fixed on the digital signal board and electrically connected to the digital signal board via a connecting terminal, wherein the metal plate comprises:

a middle plate part, wherein the middle plate part being fixedly connected to the inner end of the connecting wire;

a first lateral plate part; and a second lateral plate part, wherein the first lateral plate part and the second lateral plate part being respectively connected to two ends of a same side of the middle plate part, wherein the first lateral plate part and the second lateral plate part being both electrically connected to the digital signal board via the connecting terminal, wherein a bottom end of the first lateral plate part being provided with a first embedding part and a bottom end of the second lateral plate part being provided with a second embedding part, wherein the digital signal board being provided with a first embedding groove and a second embedding groove at a position close to an end thereof, and wherein the first embedding pan and the second embedding part being respectively embedded in the first embedding groove and the second embedding groove such that the metal plate is fixedly connected to the digital signal board.

2. The connector converter according to claim 1, wherein the digital signal board and the power source board are provided side by side.

3. The connector converter according to claim 1, wherein the digital signal board and the power source board are provided at a distance from each other.

4. The connector converter according to claim 3, wherein the plurality of output interfaces are positioned between the digital signal board and the power source board to space apart the digital signal board and the power source board.

5. The connector converter according to claim 1, wherein the digital signal board is electrically connected to the power source board via at least one pin header set.

6. The connector converter according to claim 5, wherein each of the pin header set comprises a plurality of connecting pin headers which are provided side by side, and each of the plurality of connecting pin header is vertically welded between the digital signal board and the power source board.

7. The connector converter according to claim 1, wherein a connecting position between the connecting terminal and the metal plate is provided with a UV adhesive fixedly sealing on the digital signal board.

8. The connector converter according to claim 1, wherein the digital signal board is provided with a mounting notch positioned below a position between the first lateral plate part and the second lateral plate part, and the middle plate part is clamped in the mounting notch.

9. The connector converter according to claim 1, wherein the inner end of the connecting wire is fixedly connected to the middle plate part via a wire clamping ring.

10. The connector converter according to claim 1, wherein the plurality of output interfaces are any combination of a USB interface, an HDMI interface, a DVI interface, an RJ45 interface and a Lightning interface.

11. The connector converter according to claim 1, wherein the input interface is a Type-C interface or a Micro USB interface.

12. The connector converter according to claim 1, wherein the digital signal board, the power source board, or a combination thereof is provided with a plurality of electronic devices.

13. The connector converter according to claim 1, wherein the shell comprises an outer fame and two cover plugs, wherein the outer frame is provided with a mounting cavity and the mounting cavity penetrates through two ends in a length direction of the outer frame, wherein the two cover plugs are plugged at two ends of the mounting cavity, and wherein the one or more outer pockets are formed in the outer frame, at least one of the two cover plugs, or a combination thereof.

14. A connector converter comprising:

a shell comprising an outer frame and two cover plugs, wherein the outer frame is provided with a mounting cavity and the mounting cavity penetrates through two ends in a length direction of the outer frame, wherein the two cover plugs are plugged at two ends of the mounting cavity, and wherein the shell is provided with one or more outer pockets formed in the outer frame, at least one of the two cover plugs, or a combination thereof:

a digital signal board, wherein the digital signal board is integrated with a digital circuit, wherein the digital signal board is provided in the shell and provided with a plurality of output interfaces, and wherein the one or more outer pockets are positioned corresponding to a respective output interface of the plurality of output interfaces such that the respective output interface is exposed;

a power source board provided in the shell, wherein the power source board is integrated with a power source circuit, and wherein the digital signal board and the power source board are electrically connected to each other; and a connecting wire, wherein an inner end of the connecting wire is electrically connected to the digital signal board, an outer end of the connecting wire extends out to the shell and is provided with an input interface, wherein the shell further comprises a plastic member, wherein the plastic member is fixed in the mounting cavity and provided with an inner pocket positioned corresponding to the outer pocket formed in the outer frame, and wherein an end of the output interface corresponding to the inner pocket is fixed to the inner pocket.

15. The connector converter according to claim 14, wherein the outer frame is an aluminum alloy frame with an oxide layer formed on the surface of the aluminum alloy frame.

* * * * *